US008750754B2

(12) United States Patent
Lee

(10) Patent No.: US 8,750,754 B2
(45) Date of Patent: Jun. 10, 2014

(54) IMAGE FORMING APPARATUS HAVING DRIVE DEVICE DETACHABLY COUPLED TO DEVELOPING DEVICE

(75) Inventor: Han Jun Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 824 days.

(21) Appl. No.: 12/923,346

(22) Filed: Sep. 15, 2010

(65) Prior Publication Data

US 2011/0081163 A1 Apr. 7, 2011

(30) Foreign Application Priority Data

Oct. 6, 2009 (KR) ..... 10-2009-0094689

(51) Int. Cl.
*G03G 15/08* (2006.01)

(52) U.S. Cl.
USPC ..... 399/119

(58) Field of Classification Search
USPC ..... 399/110, 119
See application file for complete search history.

(56) References Cited

U.S. PATENT DOCUMENTS

| | | | | |
|---|---|---|---|---|
| 7,693,442 | B2 * | 4/2010 | Sato et al. | 399/90 |
| 2007/0147883 | A1 * | 6/2007 | Sato et al. | 399/111 |
| 2009/0074465 | A1 * | 3/2009 | Tanaka | 399/223 |

FOREIGN PATENT DOCUMENTS

| | | |
|---|---|---|
| JP | 2006-154746 | 6/2006 |
| JP | 2008-191458 | 8/2008 |

* cited by examiner

*Primary Examiner* — Walter L Lindsay, Jr.
*Assistant Examiner* — Ruth Labombard
(74) *Attorney, Agent, or Firm* — Staas & Halsey LLP

(57) ABSTRACT

An image forming apparatus to achieve stable attachment/detachment of a developing device and stable power transmission while preventing contamination of the surroundings due to leakage of developer. The image forming apparatus includes a cover to be opened away from or closed to an upper surface of a body, and a drive device provided at a side of the developing device so as to be coupled with or released from the developing device and be moved in linkage with opening/closing of the cover. The developing device includes driven coupling members to be rotated upon receiving drive power from the drive device. The drive device includes driving coupling members engaged with the driven coupling members, and a moving member to horizontally move the driving coupling members according to the opening/closing of the cover and to control the engagement/disengagement of the driving coupling members and the driven coupling members.

18 Claims, 13 Drawing Sheets

IMAGE FORMING APPARATUS HAVING DRIVE DEVICE DETACHABLY COUPLED TO DEVELOPING DEVICE

CROSS-REFERENCE TO RELATED APPLICATIONS

This application claims the benefit of Korean Patent Application No. 2009-0094689, filed on Oct. 6, 2009 in the Korean Intellectual Property Office, the disclosure of which is incorporated herein by reference.

BACKGROUND

1. Field

Embodiments relate to an image forming apparatus to enable stable operation.

2. Description of the Related Art

Generally, image forming apparatuses are devised to form an image on a printing medium according to input signals. Examples of image forming apparatuses include printers, copiers, fax machines, and devices combining functions thereof.

In an image forming apparatus, after light is irradiated to a photoconductor that has been charged with a predetermined electric potential to form an electrostatic latent image on a surface of the photoconductor, toner, i.e. developer is fed to the electrostatic latent image, forming a visible image. The toner image, formed on the photoconductor, is directly transferred to a printing medium, or is indirectly transferred to the printing medium by way of an intermediate transfer member. The image transferred to the printing medium is fixed to the printing medium via a fusing process.

A developing device is detachably mounted in a body of the image forming apparatus. The developing device is inserted into the body and is coupled with a drive device inside the body so as to be operated upon receiving drive power from the drive device. The coupling of the developing device and the drive device is released when the developing device is separated from the body.

However, the above described conventional image forming apparatus may have unstable coupling and power-transmission between the developing device and the drive device.

In addition, if the developing device is divided into a developing process device to perform an image forming process and a developer replenishment device to replenish developer in the developing process device, developer may leak during mounting of the developer replenishment device, causing contamination of the surroundings.

SUMMARY

Therefore, it is an aspect to provide an image forming apparatus which may achieve stable attachment/detachment of a developing device and stable transmission of drive power.

It is another aspect to provide an image forming apparatus which may prevent contamination of the surroundings due to developer leaked during attachment/detachment of a developing device.

Additional aspects will be set forth in part in the description which follows and, in part, will be apparent from the description, or may be learned by practice of the invention.

In accordance with one aspect, an image forming apparatus includes a body, a developing device detachably mounted in the body, a cover to be opened away from or closed to an upper surface of the body, and a drive device provided at a side of the developing device so as to be coupled with or released from the developing device, the drive device being moved in linkage with opening/closing operation of the cover, wherein the developing device includes a plurality of driven coupling members to be rotated upon receiving drive power from the drive device, the drive device includes a plurality of driving coupling members engaged with the plurality of driven coupling members in a one to one ratio according to opening/closing operation of the cover, and at least one driving coupling member of the plurality of driving coupling members is located at a position deviated from a straight line on which the remaining driving coupling members are located.

The drive device may include a plurality of cam members to horizontally move the plurality of driving coupling members, a rack member to rotate the plurality of cam members, and a pinion member to linearly move the rack member.

The rack member may include a stepped portion to allow at least one of the cam members to be arranged at a stepped position corresponding to the at least one driving coupling member arranged at the position deviated from the straight line.

Each of the plurality of driving coupling members may include a stud as a rotation center, a gear rotatably fitted on the stud, a driving coupling integrally coupled with the gear and engaged with a corresponding one of the plurality of driven coupling members, and a spring interposed between the stud and the gear.

A position of each of the plurality of driving coupling members is changed between an engaged position where the driving coupling member is engaged with the corresponding driven coupling member and a disengaged position where the driving coupling member is disengaged from the corresponding driven coupling member, and the gear and the cam member may be kept at a constant distance to prevent friction therebetween at the engaged position.

The distance may be about 0.2 mm or more and about 0.8 mm or less.

The developing device may include a developing process device to perform an image forming process and a developer replenishment device to replenish developer in the developing process device, and the drive device may further include a developer shutter link to adjust the supply of developer from the developer replenishment device to the developing process device.

The developer shutter link may be provided at one end of the rack member and may be rotated according to linear movement of the rack member to open or close a developer shutter of the developer replenishment device.

The drive device may further include a housing defining an exterior appearance of the drive device.

The drive device may be a separate assembly module, and may allow confirmation of an operation status thereof in a state in which the drive device is not coupled to the body.

The image forming apparatus may further include a connection unit to connect the cover and the pinion member to each other, and the connection unit may include a connection member integrally formed with the cover to move along with the cover, and a link member connected to the connection member to rotate the pinion member according to movement of the connection member.

The plurality of driving coupling members may include a first driving coupling member to rotate a first driven coupling member connected to a photoconductor, a second driving coupling member to rotate a second driven coupling member connected to a developing roller, a third driving coupling member to rotate a third driven coupling member connected to a developer supply roller, and a fourth driving coupling member to rotate a fourth driven coupling member connected to an agitator, and the fourth driving coupling member may be arranged at the position deviated from the straight line.

In accordance with another aspect, an image forming apparatus includes a body, a developing device detachably mounted in the body, a cover to be opened away from or closed to an upper surface of the body, and a drive device to be coupled with or separated from the developing device in linkage with opening/closing operation of the cover, the drive device being a separate assembly module to allow confirmation of an operation status thereof in a state in which the drive device is not assembled into the body, wherein the developing device includes a plurality of driven members to be rotated upon receiving drive power from the drive device, at least one of the driven members being located at a position deviated from a straight line on which the remaining driven members are located, and the drive device includes a plurality of driving members engaged respectively with the plurality of driven members according to opening/closing operation of the cover.

Each of the plurality of driving members may include a stud as a rotation center, a gear rotatably fitted on the stud, a driving coupling integrally coupled with the gear and engaged with a corresponding one of the plurality of driven members, and a spring interposed between the stud and the gear.

The drive device may include a plurality of cam members each adapted to horizontally move the driving coupling, a rack member to rotate the plurality of cam members, and a pinion member to linearly move the rack member.

A position of each of the plurality of driving members may be changed between a transmission position where the driving member is engaged with the corresponding driven member to transmit power and a separated position where the driving member is disengaged from the corresponding driven member so as not to transmit power, and the gear and the cam member may be kept at a constant distance to prevent friction therebetween at the transmission position.

In accordance with a further aspect, an image forming apparatus includes a body, a developing device detachably mounted in the body, a cover to be opened away from or closed to an upper surface of the body, and a drive device provided at a side of the developing device so as to be coupled with or released from the developing device, the drive device being moved in linkage with opening/closing operation of the cover, wherein the developing device includes a plurality of driven coupling members to be rotated upon receiving drive power from the drive device, and the drive device includes a plurality of driving coupling members engaged with the plurality of driven coupling members, and a moving member to horizontally move the plurality of driving coupling members according to the opening/closing operation of the cover and to control the engagement and disengagement of the driving coupling members and the driven coupling members.

Each of the plurality of driving coupling members may include a stud as a rotation center, a gear rotatably fitted on the stud, a driving coupling integrally coupled with the gear and engaged with a corresponding one of the plurality of driven coupling members, and a spring interposed between the stud and the gear.

The moving member may include a plurality of cam members to restrict horizontal movement of the gear and the driving coupling, a rack member to rotate the plurality of cam members, and a pinion member to linearly move the rack member.

A position of each of the plurality of driving coupling members may be changed between an engaged position where the driving coupling member is engaged with the corresponding driven coupling member and a disengaged position where the driving coupling member is disengaged from the corresponding driven coupling member, and the gear and the cam member may be kept at a constant distance to prevent friction therebetween at the engaged position.

The developing device may include a developing process device to perform an image forming process and a developer replenishment device to replenish developer in the developing process device, and the drive device may include a developer shutter link to adjust the supply of developer from the developer replenishment device to the developing process device.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
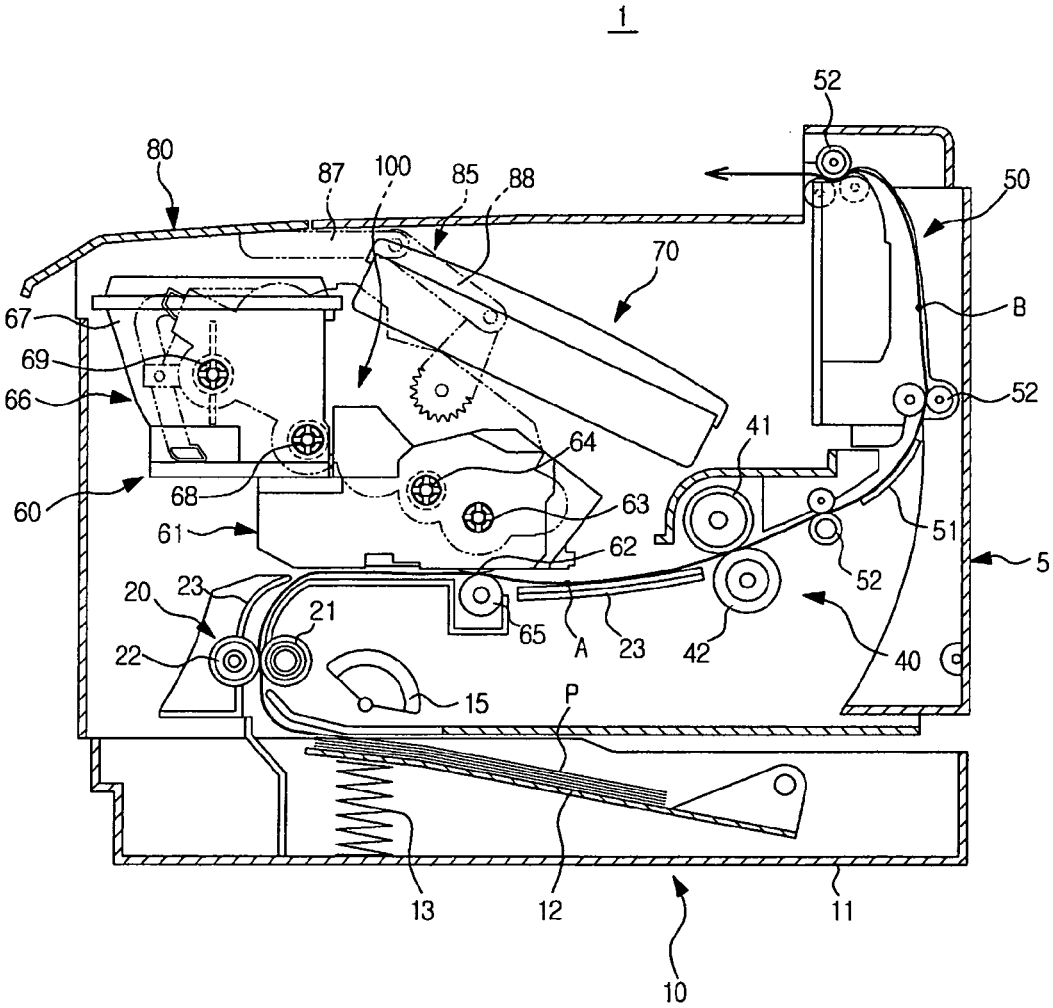
FIG. 1 is a view illustrating an interior configuration of an image forming apparatus according to an embodiment.

Reference will now be made in detail to the embodiments, examples of which are illustrated in the accompanying drawings, wherein like reference numerals refer to like elements throughout.

FIG. 1 is a view illustrating an interior configuration of an image forming apparatus according to an embodiment.

As illustrated in FIG. 1, the image forming apparatus 1 includes a body 5, a paper supply device 10 in which paper P is loaded, a feeding device 20 to feed the paper P, a developing device 60 to form an image on the paper P, a drive device 100 to drive the developing device 60, a fusing device 40 to fuse the image to the paper P, a discharge device 50 to discharge the paper P, and a cover 80 to be opened away from or closed to an upper front portion of the body 5.

The paper supply device 10 serves to supply the paper P and is installed below the body 5. The paper supply device 10 includes a paper supply tray 11 in the form of a cassette, and a press plate 12 and a press spring 13 to push the paper P inside the paper supply tray 11 upward to a pickup roller 15.

The press spring 13 is installed below the press plate 12, to push the press plate 12 toward the pickup roller 15. The pickup roller 15 picks up the paper P sheet by sheet via rotation thereof, to supply the paper P to the feeding device 20.

The feeding device 20 feeds the paper P picked up by the pickup roller 15 in a print path A. The feeding device 20 includes a feeding roller 21, a feeding backup roller 22, and a feeding guide 23 to define the print path A.

The developing device 60 includes a developing process device 61 to perform an image forming process on the paper P and a developer replenishment device 66 to replenish developer in the developing process device 61. The developing process device 61 and the developer replenishment device 66 are separated from each other and are detachably mounted respectively inside the body 5. The developing process device 61 is first mounted in the body 5 and thereafter, the developer replenishment device 66 is coupled to the developing process device 61.

The developing process device 61 includes a photoconductor 62 located on the print path A, on a surface of which an electrostatic latent image is formed, a charge roller (not shown) to charge the photoconductor 62, and a developing roller (not shown) to form a visible image by supplying the developer to the electrostatic latent image formed on the photoconductor 62. The photoconductor 62 is connected to and is rotated by a first driven coupling member 63, and the developing roller is connected to and is rotated by a second driven coupling member 64.

The developer replenishment device 66 includes a supply roller (not shown) to supply the developer to the developing roller, a developer reservoir 67 in which the developer is received, and a developer agitator (not shown) installed inside the developer reservoir 67 to agitate the developer. The supply roller is connected to and is rotated by a third driven coupling member 68, and the developer agitator is connected to and is rotated by a fourth driven coupling member 69.

The drive device 100 is provided at one side of the developing device 60. The driving device 100 will be described hereinafter.

In the meantime, a transfer roller 65, which is given as a transfer device by way of example, is arranged on the print path A to transfer the image from the photoconductor 62 to the paper P.

A Laser Scanning Unit (LSU) 70 is provided in the body 5 to form the electrostatic latent image by irradiating a laser beam containing image information to the photoconductor 62 that has been charged.

The fusing device 40 includes a heating roller 41 and a press roller 42. The fusing device 40 applies heat and pressure to the developer image transferred to the paper P passing between the heating roller 41 and the press roller 42, allowing the developer image to be fused to the paper P.

The discharge device 50 feeds the paper P having passed through the fusing device 40 to a discharge region defined at the top of the body 5. The discharge device 50 includes discharge guides 51 to guide the paper P to the discharge region, and a plurality of discharge rollers 52 arranged on a discharge path B.

The cover 80 is upwardly or downwardly opened away from or closed to an upper front portion of the body 5. The cover 80 is connected to a rack member 140 of the drive device 100 that will be described hereinafter by use of a connection unit 85. The connection unit 85 includes a connection member 87 integrally formed with the cover 80 to be moved along with the cover 80, and a link member 88 connected to the connection member 87 to rotate the rack member 140 according to movement of the connection member 87. Specifically, if a user opens the cover 80, the connection member 87 pulls the link member 88 and in turn, the link member 88 pulls and rotates the rack member 140.

Now, the drive device 100 will be described in detail.

Figure 2:
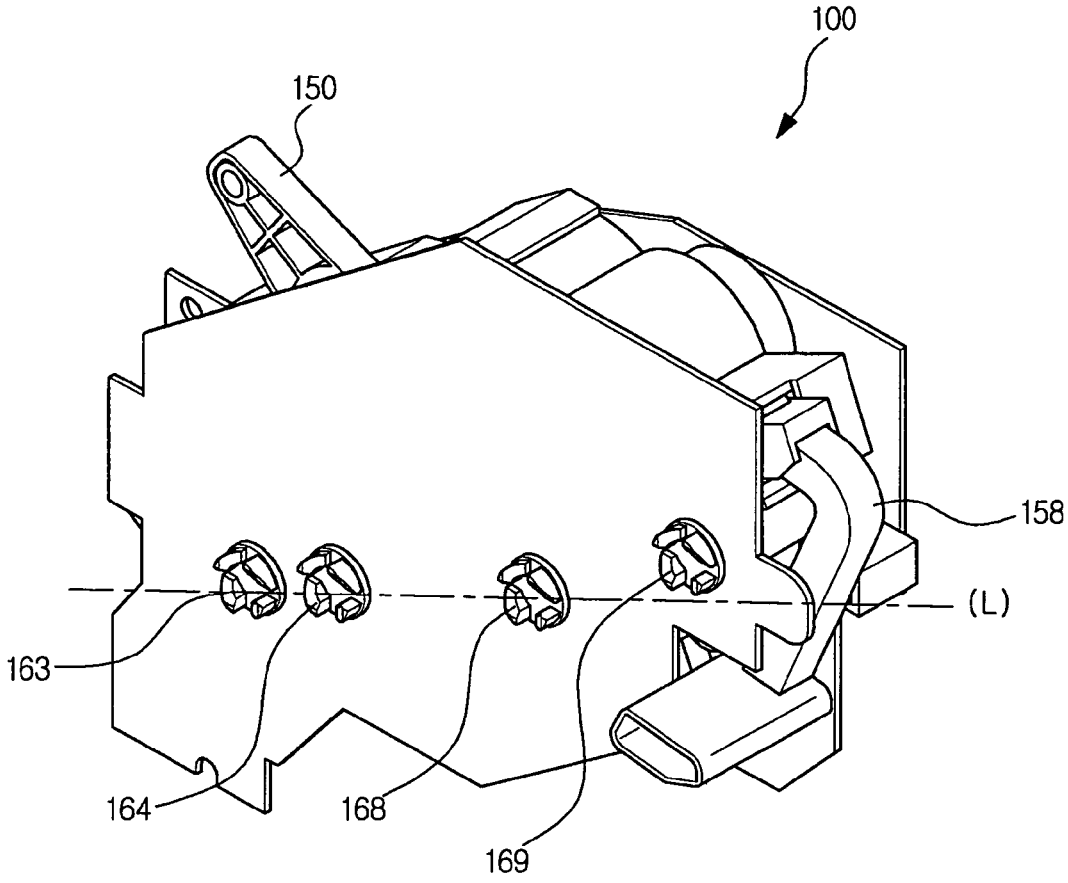
FIG. 2 is a perspective view illustrating an exterior appearance of a drive device according to an embodiment.
Figure 3:
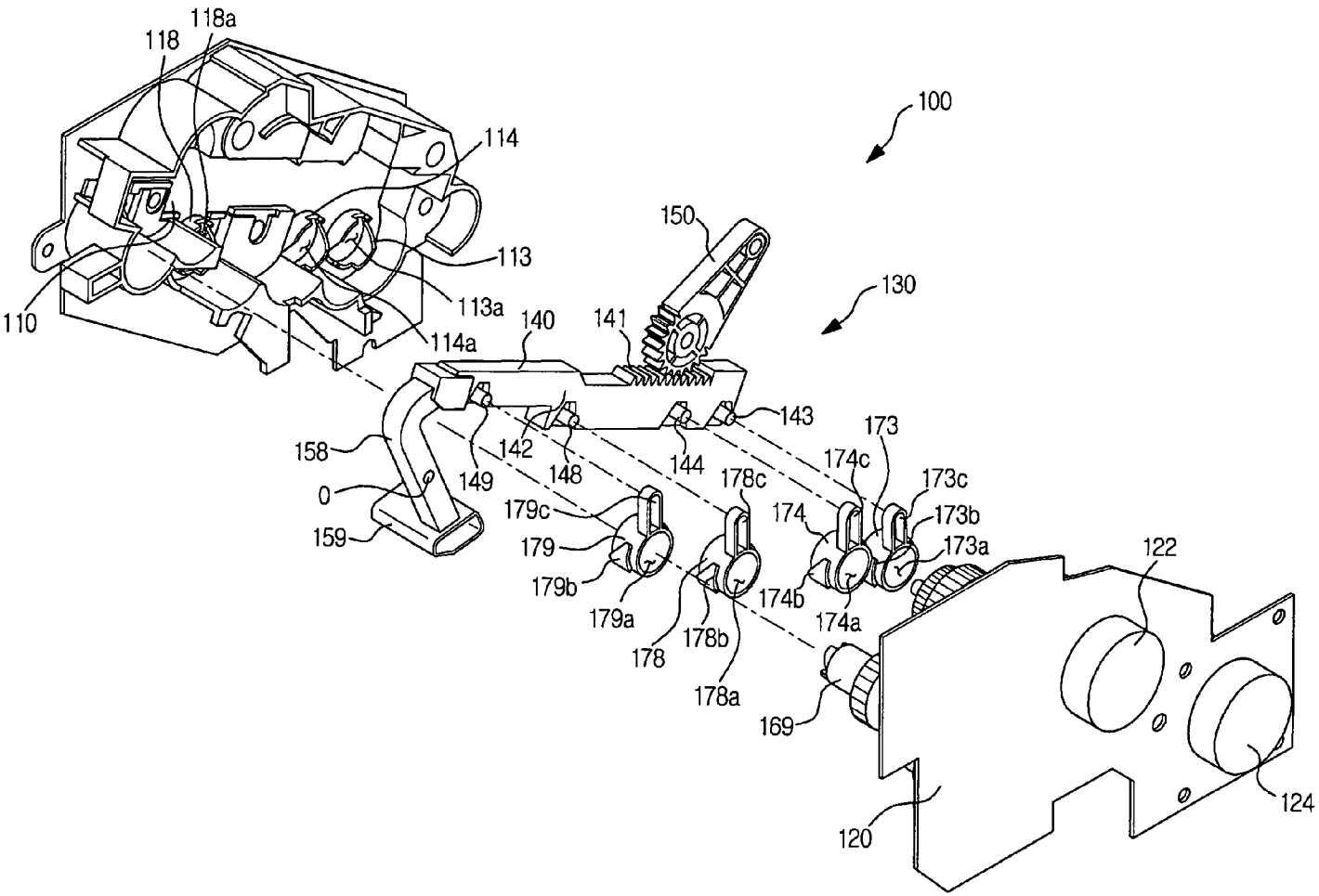
FIG. 3 is an exploded perspective view of the drive device illustrated in FIG. 2.
Figure 4A:
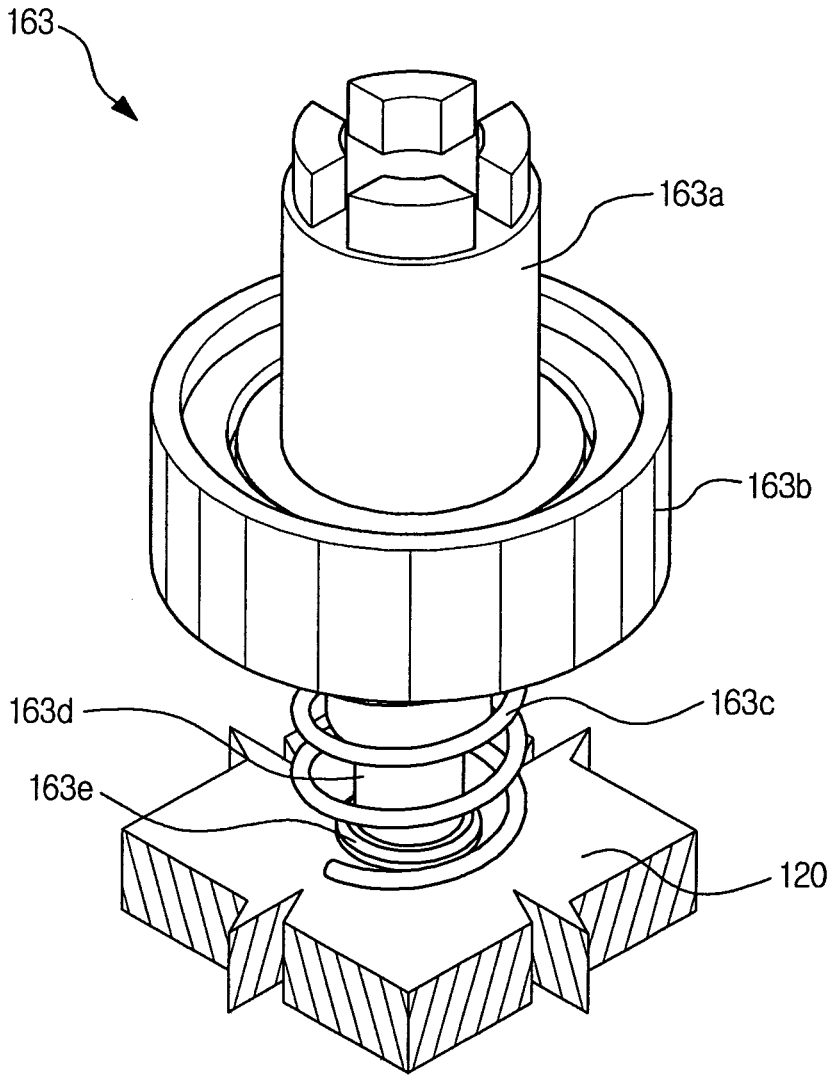
FIG. 4A is a perspective view illustrating an exterior appearance of a drive coupling member.
Figure 4B:
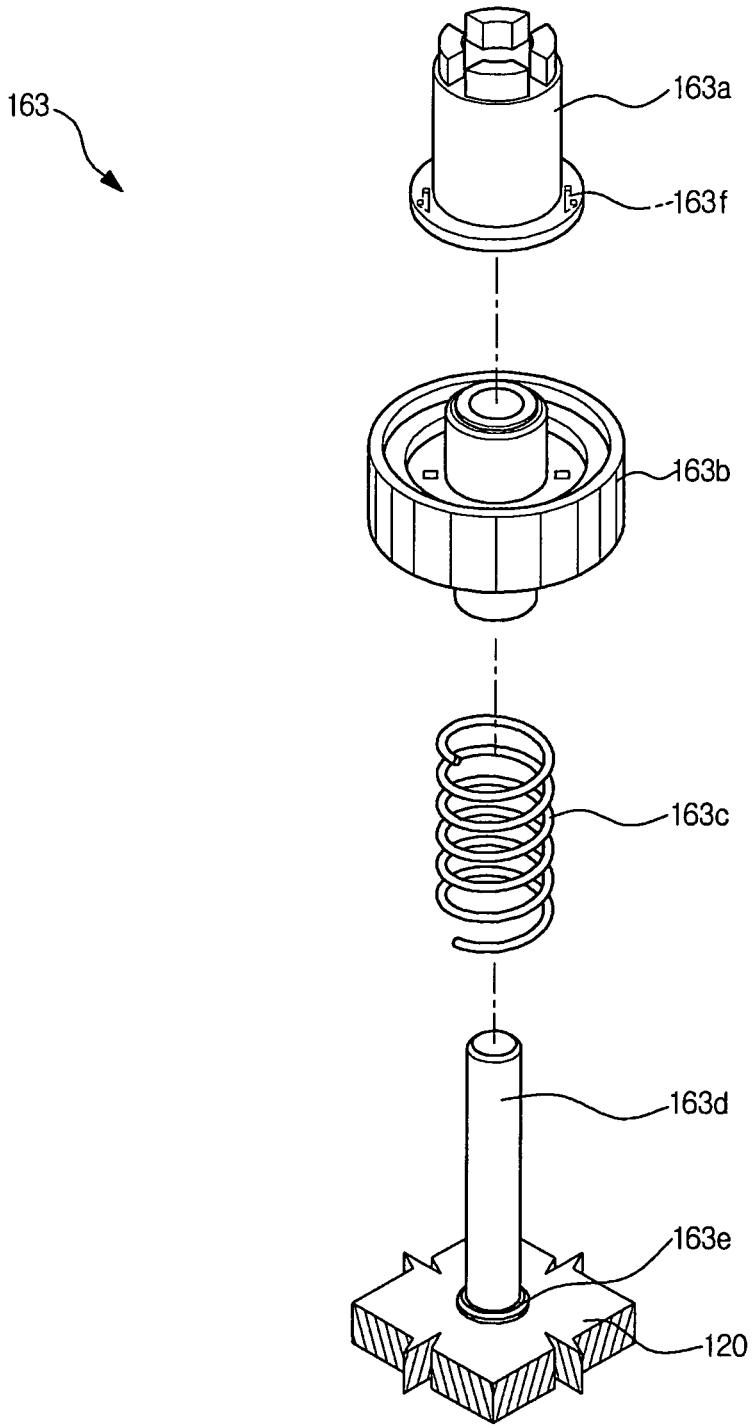
FIG. 4B is an exploded perspective view of the drive coupling member.
Figure 4C:
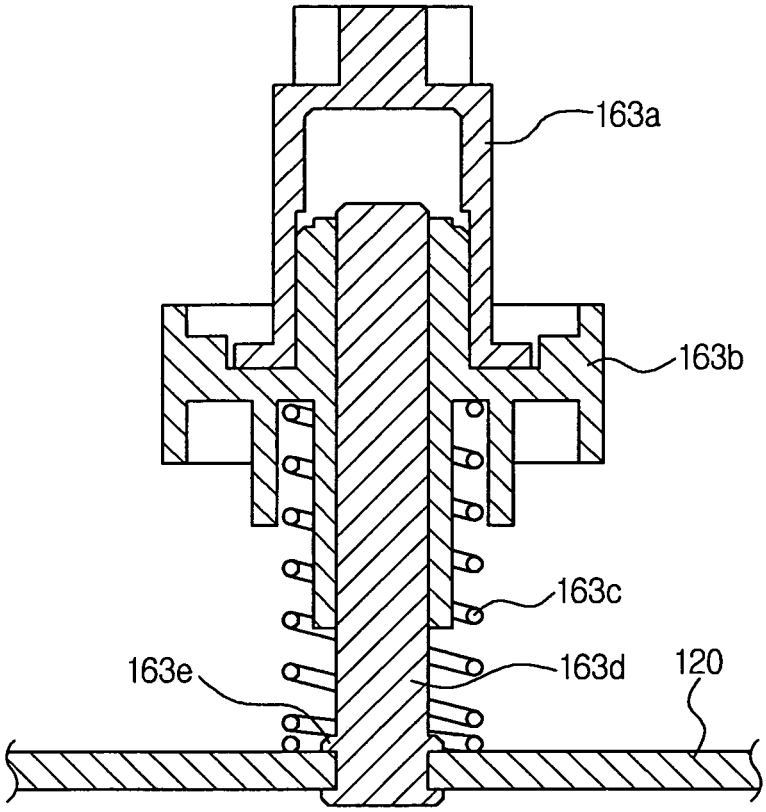
FIG. 4C is a sectional view of the drive coupling member.

FIG. 2 is a perspective view illustrating an exterior appearance of the drive device according to an embodiment, and FIG. 3 is an exploded perspective view of the drive device illustrated in FIG. 2. FIG. 4A is a perspective view illustrating an exterior appearance of a drive coupling member, FIG. 4B is an exploded perspective view of the drive coupling member, and FIG. 4C is a sectional view of the drive coupling member.

As illustrated in FIGS. 2 and 3, the drive device 100 includes a plurality of driving coupling members 163, 164, 168 and 169 releasably engaged with the driven coupling members 63, 64, 68 and 69 of the developing device 60, a moving member 130 to horizontally move the plurality of driving coupling members 163, 164, 168 and 169 according to opening/closing operations of the cover 80, and first and second housings 110 and 120 defining an exterior appearance of the drive device 100.

The driving coupling members 163, 164, 168 and 169 are engaged with or are disengaged from the driven coupling members 63, 64, 68 and 69 via leftward or rightward movement thereof. In the present embodiment, there are four driving coupling members 163, 164, 168 and 169 and four driven coupling members 63, 64, 68 and 69. The first driving coupling member 163 is engaged with the first driven coupling member 63, the second driving coupling member 164 is engaged with the second driven coupling member 64, the third driving coupling member 168 is engaged with the third driven coupling member 68, and the fourth driving coupling member 169 is engaged with the fourth driven coupling member 69. The driving coupling members 163, 164, 168 and 169 provide drive power, and the driven coupling members 63, 64, 68 and 69 are rotated upon receiving the drive power.

Of the plurality of driving coupling members 163, 164, 168 and 169, three driving coupling members 163, 164 and 168 are arranged at positions on a single straight line L, whereas the remaining one driving coupling member 169 is arranged deviated from the straight line L. Although positions of coupling members have been conventionally limited onto a single straight line, the embodiment allows the driving coupling member 169 and the driven coupling member 69 to be engaged with each other at a position except for the straight line, owing to a rack member 140 having a stepped portion 142.

Once the driving coupling members 163, 164, 168 and 169 are engaged with the driven coupling members 63, 64, 68 and 69, the driving coupling members 163, 164, 168 and 169 are rotated upon receiving drive power from an internal element of the drive device 100, thus rotating the driven coupling members 63, 64, 68 and 69 engaged therewith and consequently, causing operation of the developing device 60. The driving coupling members 163, 164, 168 and 169 are respectively fitted to cam members 173, 174, 178 and 179 and holes 113*a*, 114*a* and 118*a* formed in the first housing 110. Detailed configurations of the driving coupling members 163, 164, 168 and 169 will be described hereinafter.

The moving member 130 includes the plurality of cam members 173, 174, 178 and 179 to horizontally move the plurality of the driving coupling members 163, 164, 168 and 169, the rack member 140 to rotate the plurality of cam members 173, 174, 178 and 179, a pinion member 150 to linearly reciprocate the rack member 140, and a developer shutter link 158 to adjust the supply of developer from the developer replenishment device 66 into the developing process device 61.

In the present embodiment, the four cam members 173, 174, 178 and 179 are used. The cam members 173, 174, 178 and 179 respectively have central cam holes 173*a*, 174*a*, 178*a* and 179*a*, cam slopes 173*b*, 174*b*, 178*b* and 179*b* formed at an outer periphery thereof, and cam coupling holes 173*c*, 174*c*, 178*c* and 179*c* for connection of the rack member 140. As the respective cam slopes 173*b*, 174*b*, 178*b* and 179*b* move on housing slopes 113, 114 and 118 provided inside the first housing 110, the cam members 173, 174, 178 and 179 act to restrict horizontal movements of the driving coupling members 163, 164, 168 and 169.

The rack member 140 is linearly reciprocated by the pinion member 150. One end of the rack member 140 is provided with gear teeth 141 for coupling of the pinion member 150, and the other end of the rack member 140 is provided with the developer shutter link 158. The rack member 140 has rack protrusions 143, 144, 148 and 149 formed at a side surface thereof so as to be inserted into the cam coupling holes 173*c*, 174*c*, 178*c* and 179*c* of the cam members 173, 174, 178 and 179. Once the rack protrusions 143, 144, 148 and 149 are inserted into the cam coupling holes 173*c*, 174*c*, 178*c* and 179*c*, linear movement of the rack member 140 is converted into rotation of the cam members 173, 174, 178 and 179.

The rack member 140 has an elongated bar shape and has the stepped portion 142. Although will be described hereinafter, the stepped portion 142 assists arrangement and rotation of the cam member 179 corresponding to the driving coupling member 169 that is located at a position deviated from the straight line L.

The pinion member 150 is engaged with the gear teeth 141 of the rack member 140 and acts to linearly reciprocate the rack member 140 upon receiving opening/closing force of the cover 80.

The developer shutter link 158 is provided at the end of the rack member 140 and is rotated about a rotation center O thereof during linear movement of the rack member 140. A switching member 159 provided at an end of the developer shutter link 158 turns on or off a switch (not shown) of the developer replenishment device 66, enabling opening/closing of a developer shutter (not shown) inside the developer replenishment device 66.

The first housing 110 and the second housing 120 are coupled to each other to define an exterior appearance of the drive device 100. A variety of elements, including the driving coupling members 163, 164, 168 and 169 and the moving member 130, are arranged between the first housing 110 and the second housing 120.

The drive device 100 may take the form of a separate assembly module of the first housing 110 and the second housing 120. Accordingly, it may be possible to confirm whether or not the drive device 100 is accurately operated prior to mounting the drive device 100 into the body 5. Even if the image forming apparatus 1 malfunctions, the drive device 100 alone is separated to inspect the malfunction thereof.

Referring to FIGS. 4A to 4C, the first driving coupling member 163 includes a stud 163*d* serving as a rotation center, a gear 163*b* rotatably fitted on the stud 163*d*, a driving coupling 163*a* integrally coupled with the gear 163*b* and engaged with the first driven coupling member 63, and a spring 163*c* interposed between the stud 163*d* and the gear 163*b*.

The stud 163*d* is fixed to the second housing 120 and an anti-noise washer 163*e* is fastened to the stud 163*d*.

The gear 163*b* is rotated about the stud 163*d* at an upper side of the stud 163*d*.

The driving coupling 163*a* is directly engaged with the first driven coupling member 63 and serves to transmit drive power. The driving coupling 163*a* is coupled with the gear 163*b* by a hook 163*f* and is rotated simultaneously with the gear 163*b*.

The spring 163*c* provides the driving coupling 163*a* and the gear 163*b* with elasticity and interacts with the cam member 173 to cause horizontal movement of the first driving coupling member 163.

The first driving coupling member 163 minimizes torsion of the driving coupling 163*a* and the gear 163*b* by virtue of use of the stud 163*d*, and enables stable transmission of drive power to the first driven coupling member 63. Specifically, even if the first driving coupling 163*a* and the gear 163*b* are rotated, the stud 163*d* may prevent shaking of the first driving coupling member 163, thus enabling stable transmission of drive power. The above described detailed configurations related to the first driving coupling member 163 are directly applied to the second driving coupling member 164 to the fourth driving coupling member 169.

Now, operation of the driving device 100 according to the embodiment will be described.

Figure 5A:
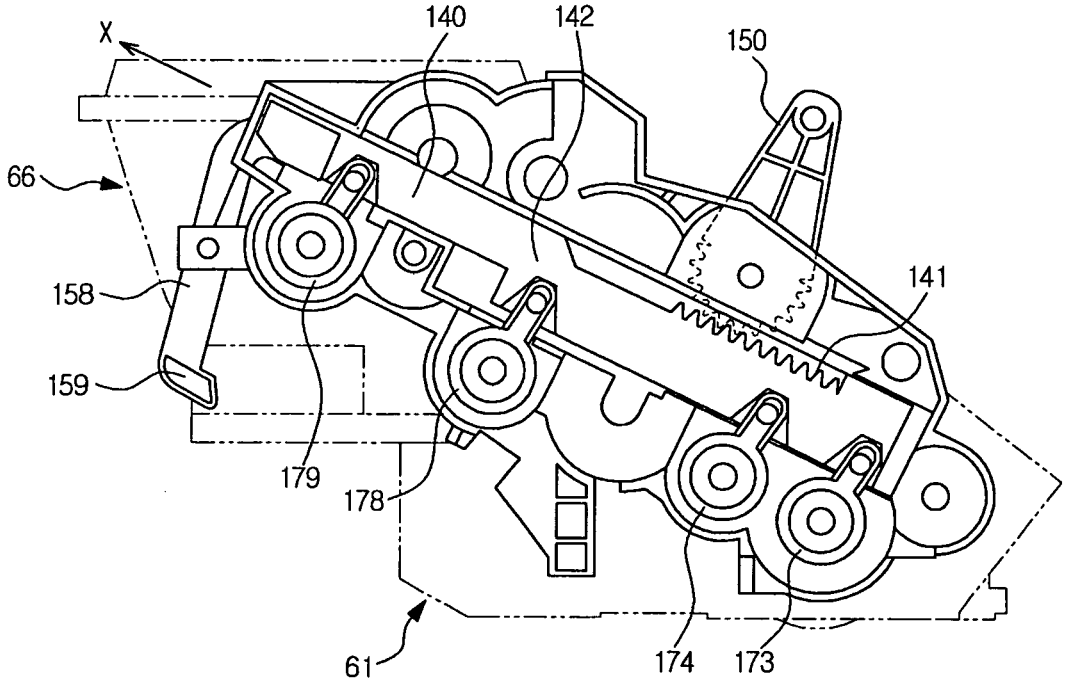
FIG. 5A is a sectional view illustrating the drive device and a developing device in an open state of a cover.
Figure 5B:
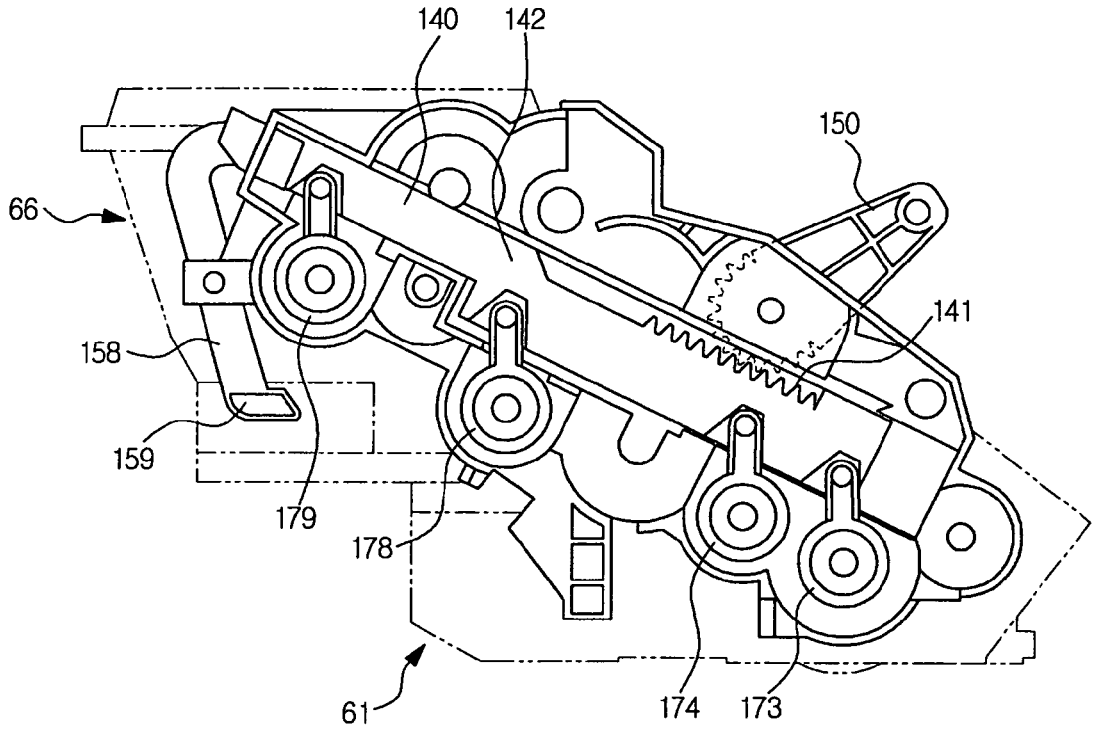
FIG. 5B is a sectional view illustrating the drive device and the developing device in a closed state of the cover.
Figure 6A:
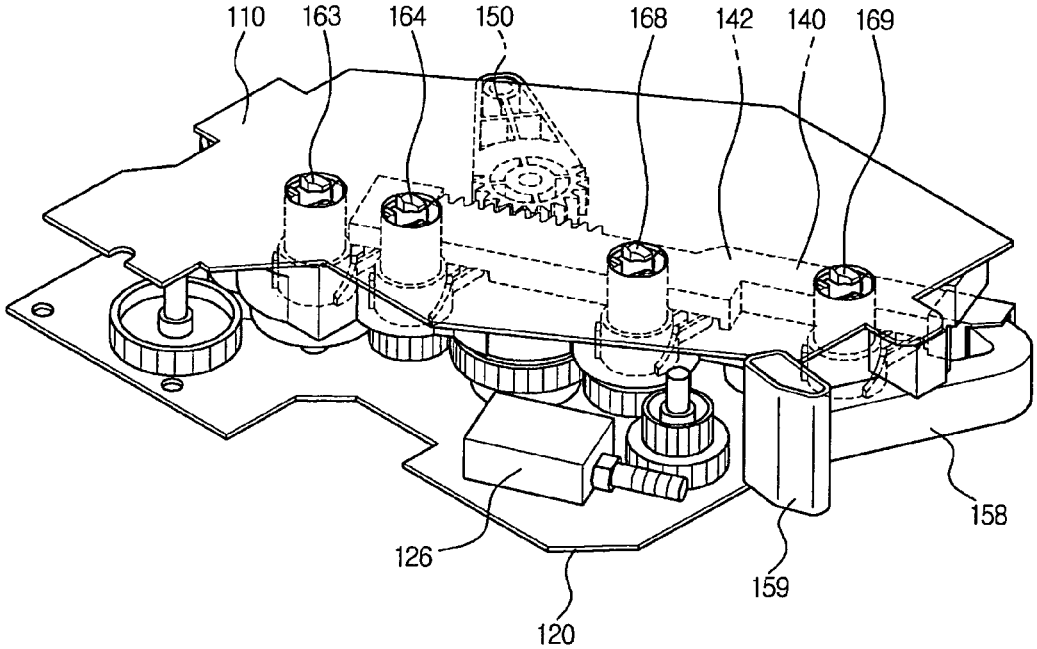
FIG. 6A is a perspective view illustrating the drive device in the open state of the cover.
Figure 6B:
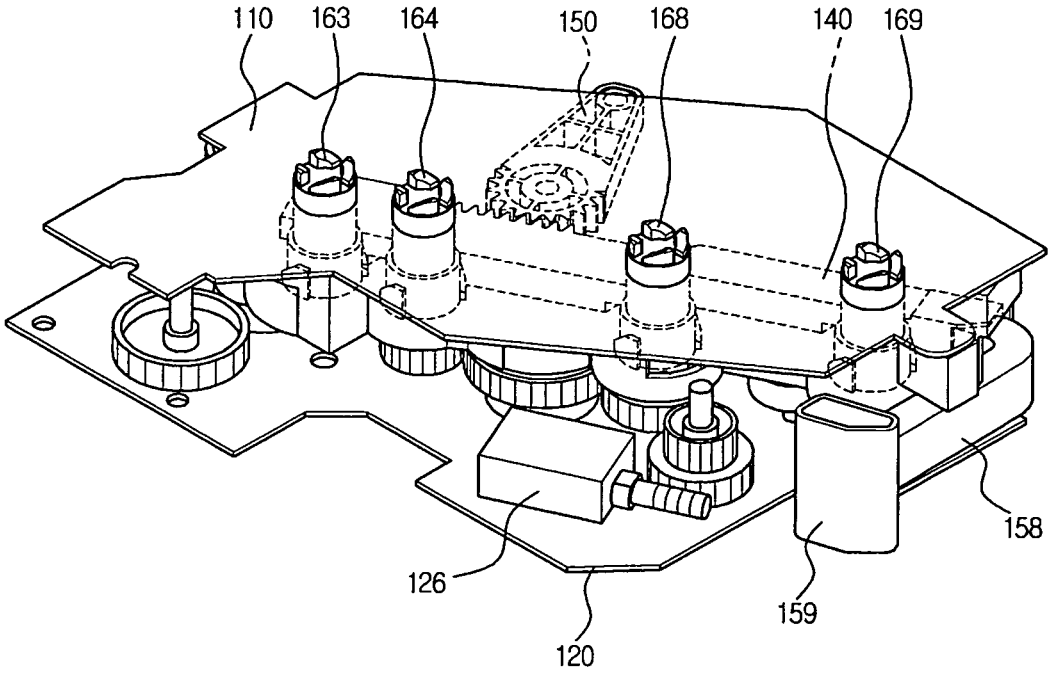
FIG. 6B is a perspective view illustrating the drive device in the closed state of the cover.
Figure 7A:
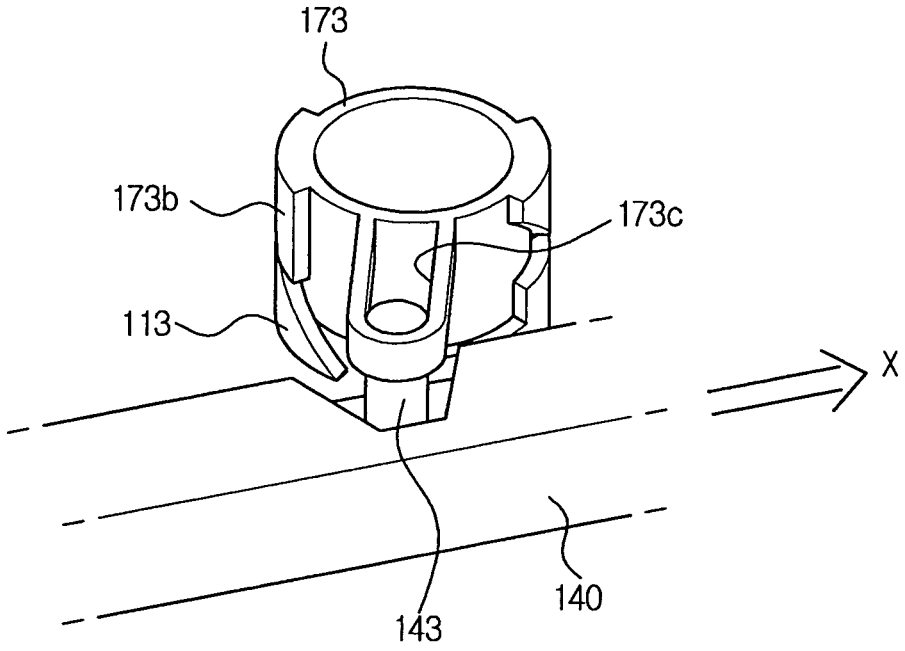
FIG. 7A is a perspective view illustrating a cam member and a rack member in the open state of the cover.
Figure 7B:
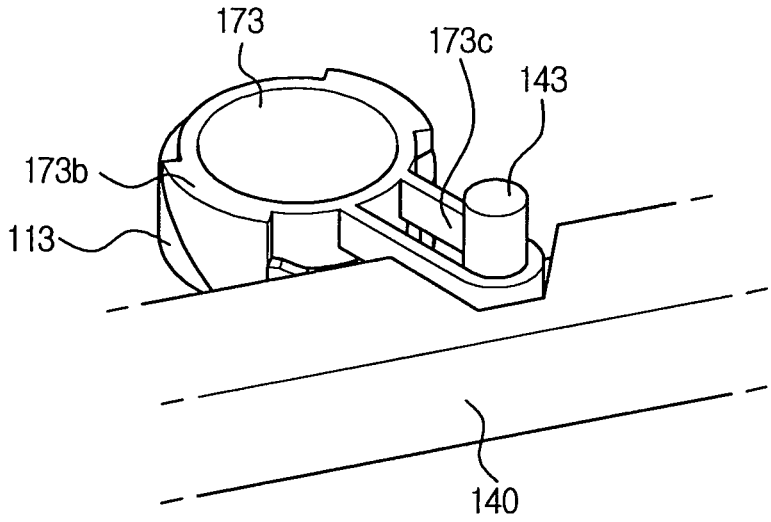
FIG. 7B is a perspective view illustrating the cam member and the rack member in the closed state of the cover.
Figure 8:
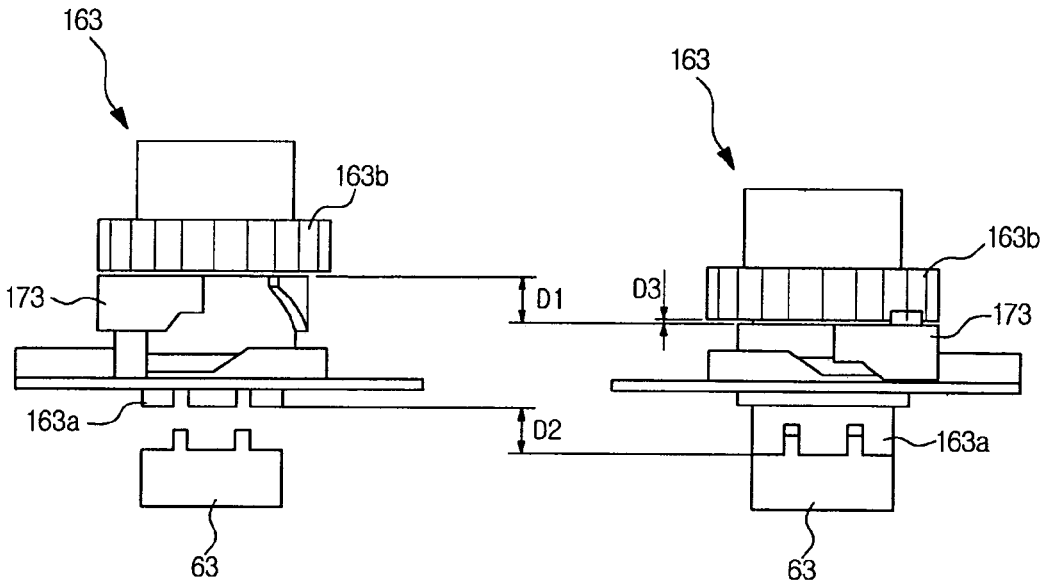
FIG. 8 is a view illustrating operations of the cam member and the rack member before and after the opening/closing of the cover.

FIG. 5A is a sectional view illustrating the drive device and the developing device in an open state of the cover, and FIG. 5B is a sectional view illustrating the drive device and the developing device in a closed state of the cover. FIG. 6A is a perspective view illustrating the drive device in the open state of the cover, and FIG. 6B is a perspective view illustrating the drive device in the closed state of the cover. FIG. 7A is a perspective view illustrating the cam member and the rack member in the open state of the cover, and FIG. 7B is a perspective view illustrating the cam member and the rack member in the closed state of the cover. FIG. 8 is a view illustrating operations of the cam member and the rack member before and after the opening/closing of the cover.

Referring to FIGS. 5A to 6B, in an open state of the cover 80 (FIGS. 5A and 6A), the driving coupling members 163, 164, 168 and 169 are respectively kept in a disengaged state in that the engagement of the driving coupling members 163, 164, 168 and 169 and the driven coupling members 63, 64, 68 and 69 is released. The switch of the developer replenishment device 66 is turned off by the switching member 159 of the developer shutter link 158. Accordingly, the developer shutter is closed to prevent the developer of the developer replenishment device 66 from moving into the developing process device 61.

If the user closes the cover 80, the connection unit 85 pushes and rotates the pinion member 150, causing the rack member 140 to be moved in an "X" direction to a position as illustrated in FIGS. 5B and 6B. Thereby, the driving coupling members 163, 164, 168 and 169 are respectively moved toward the developing device 60 and are engaged with the driven coupling members 63, 64, 68 and 69. In this way, the driving coupling members 163, 164, 168 and 169 are kept in an engaged position to transmit drive power. Simultaneously, the developer shutter link 158 is rotated to allow the switching member 159 to turn on the switch of the developer replenishment device 66. As the developer shutter of the developer replenishment device 66 is opened, the developer may be replenished from the developer replenishment device 66 to the developing process device 61.

In short, upon closing the cover 80, the driving coupling members 163, 164, 168 and 169 are engaged with the driven coupling members 63, 64, 68 and 69 to transmit drive power, and the developer may move from the developer replenishment device 66 into the developing process device 61.

Conventionally, the opening/closing of the developer shutter is accomplished upon attachment/detachment of the developer replenishment device 66, thus causing leakage of the developer and contamination of the surroundings. However, in the embodiment, the developer shutter is opened or closed by the shutter link 158 that is operated in linkage with opening/closing operations of the cover 80 after the developer replenishment device 66 is completely mounted. This prevents leakage of developer or contamination of the surroundings.

Motors 122, 124 and 126 of the drive device 100 are rotated in a closed state of the cover 80, and drive power is transmitted to gears (not shown) inside the drive device 100 to rotate the gears of the driving coupling members 163, 164, 168 and 169. Also, the driving couplings integrally coupled with the gears are rotated, transmitting drive power to the driven coupling members 63, 64, 68 and 69.

In the meantime, interaction of the cam member 173 and the rack member 140 will be described in detail. As illustrated in FIGS. 7A and 8, when the rack member 140 is moved in the "X" direction, the cam member 173 connected to the rack member 140 via the rack protrusion 143 is rotated. The slope 173*b* of the cam member 173 moves on the slope 113 of the first housing 110 and simultaneously, the first driving coupling member 163 is moved toward the developing device 60 by elasticity of the spring 163*c* to thereby be engaged with the first driven coupling member 63.

In a state wherein the first driving coupling member 163 and the first driven coupling member 63 are engaged with each other, the gear 163*b* and the cam member 173 are spaced apart from each other by a constant distance "D3" to prevent rotational friction therebetween. This may prevent generation of noise and abrasion of elements.

Now, the principle of maintaining the constant distance "D3" will be explained. The cam member 173 is moved by a distance "D1" during coupling operation thereof, and the driving coupling member 163 has a limited movement distance "D2" due to the presence of the driven coupling member 63. In conclusion, the constant distance "D3" between the cam member 173 and the gear 163*b* is maintained. More specifically, the distance "D3" may be in a range of 0.2 mm or more and 0.8 mm or less and in particular, may be 0.5 mm. The above described detailed configurations related to the first driving coupling member 163 are directly applied to the second driving coupling member 164 to the fourth driving coupling member 169.

Accordingly, the image forming apparatus 1 may accomplish stable operation with use of the above described drive device 100.

As apparent from the above description, in an image forming apparatus according to an embodiment, coupling members of a developing device and a drive device are engaged with or disengaged from each other in linkage with opening/closing operations of a cover, enabling stable coupling of the developing device and the drive device.

Even when a plurality of coupling members is irregularly arranged, stable engagement or disengagement of the developing device and the drive device may be accomplished.

Further, with use of a stud serving as a rotation center of the coupling member, the image forming apparatus may accomplish stable operation thereof.

Furthermore, a developer shutter is opened or closed in linkage with an opening/closing operation of the cover. This may prevent leakage of developer and contamination of the surroundings upon attachment/detachment of the developing device.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a body;

a developing device detachably mounted in the body;

a cover to be opened away from or closed to an upper surface of the body; and a drive device provided at a side of the developing device so as to be coupled with or released from the developing device, the drive device being moved in linkage with opening/closing operation of the cover, wherein the developing device includes a plurality of driven coupling members to be rotated upon receiving drive power from the drive device, wherein the drive device includes a plurality of driving coupling members engaged with the plurality of driven coupling members in a one to one ratio according to an opening/closing operation of the cover, wherein at least one driving coupling member of the plurality of driving coupling members is located at a position deviated from a straight line on which the remaining driving coupling members are located, and wherein the drive device includes a plurality of cam members to horizontally move the plurality of driving coupling members, a rack member to rotate the plurality of cam members, and a pinion member to linearly move the rack member.

2. The image forming apparatus according to claim 1, wherein the rack member includes a stepped portion to allow at least one of the cam members to be arranged at a stepped position corresponding to the at least one driving coupling member arranged at the position deviated from the straight line.

3. The image forming apparatus according to claim 2, wherein:

the plurality of driving coupling members includes a first driving coupling member to rotate a first driven coupling member connected to a photoconductor, a second driving coupling member to rotate a second driven coupling member connected to a developing roller, a third driving coupling member to rotate a third driven coupling member connected to a developer supply roller, and a fourth driving coupling member to rotate a fourth driven coupling member connected to an agitator; and the fourth driving coupling member is arranged at the position deviated from the straight line.

4. The image forming apparatus according to claim 1, wherein each of the plurality of driving coupling members includes a stud as a rotation center, a gear rotatably fitted on the stud, a driving coupling integrally coupled with the gear and engaged with a corresponding one of the plurality of driven coupling members, and a spring interposed between the stud and the gear.

5. The image forming apparatus according to claim 4, wherein:

a position of each of the plurality of driving coupling members is changed between an engaged position where the driving coupling member is engaged with the corresponding driven coupling member and a disengaged position where the driving coupling member is disengaged from the corresponding driven coupling member; and the gear and the cam member are kept at a constant distance to prevent friction therebetween at the engaged position.

6. The image forming apparatus according to claim 5, wherein the distance is about 0.2 mm or more and about 0.8 mm or less.

7. The image forming apparatus according to claim 1, wherein:

the developing device includes a developing process device to perform an image forming process and a developer replenishment device to replenish developer in the developing process device; and the drive device further includes a developer shutter link to adjust the supply of developer from the developer replenishment device to the developing process device.

8. The image forming apparatus according to claim 7, wherein the developer shutter link is provided at one end of the rack member and is rotated according to linear movement of the rack member to open or close a developer shutter of the developer replenishment device.

9. The image forming apparatus according to claim 1, wherein the drive device further includes a housing defining an exterior appearance of the drive device.

10. The image forming apparatus according to claim 9, wherein the drive device is a separate assembly module, and allows confirmation of an operation status thereof in a state in which the drive device is not coupled to the body.

11. The image forming apparatus according to claim 1, further comprising a connection unit to connect the cover and the pinion member to each other, wherein the connection unit includes a connection member integrally formed with the cover to move along with the cover, and a link member connected to the connection member to rotate the pinion member according to movement of the connection member.

12. An image forming apparatus comprising:

a body;

a developing device detachably mounted in the body;

a cover to be opened away from or closed to an upper surface of the body; and a drive device to be coupled with or separated from the developing device in linkage with opening/closing operation of the cover, the drive device being a separate assembly module to allow confirmation of an operation status thereof in a state in which the drive device is not assembled into the body;

wherein the developing device includes a plurality of driven members to be rotated upon receiving drive power from the drive device, at least one of the driven members being located at a position deviated from a straight line on which the remaining driven members are located, wherein the drive device includes a plurality of driving members engaged respectively with the plurality of driven members according to opening/closing operation of the cover, and wherein the drive device includes a plurality of cam members each adapted to horizontally move the driving coupling, a rack member to rotate the plurality of cam members, and a pinion member to linearly move the rack member.

13. The image forming apparatus according to claim 12, wherein each of the plurality of driving members includes a stud as a rotation center, a gear rotatably fitted on the stud, a driving coupling integrally coupled with the gear and engaged with a corresponding one of the plurality of driven members, and a spring interposed between the stud and the gear.

14. The image forming apparatus according to claim 12, wherein a position of each of the plurality of driving members is changed between a transmission position where the driving member is engaged with the corresponding driven member to transmit power and a separated position where the driving member is disengaged from the corresponding driven member so as not to transmit power; and the gear and the cam member are kept at a constant distance to prevent friction therebetween at the transmission position.

15. An image forming apparatus comprising:

a body;

a developing device detachably mounted in the body;

a cover to be opened away from or closed to an upper surface of the body; and a drive device provided at a side of the developing device so as to be coupled with or released from the developing device, the drive device being moved in linkage with opening/closing operation of the cover, wherein the developing device includes a plurality of driven coupling members to be rotated upon receiving drive power from the drive device, wherein the drive device includes a plurality of driving coupling members engaged with the plurality of driven coupling members, and a moving member to horizontally move the plurality of driving coupling members according to the opening/closing operation of the cover and to control the engagement and disengagement of the driving coupling members and the driven coupling members, wherein the moving member includes a plurality of cam members to horizontally move the plurality of driving coupling members, a rack member to rotate the plurality of cam members, and a pinion member to linearly move the rack member.

16. The image forming apparatus according to claim 15, wherein each of the plurality of driving coupling members includes a stud as a rotation center, a gear rotatably fitted on the stud, a driving coupling integrally coupled with the gear and engaged with a corresponding one of the plurality of driven coupling members, and a spring interposed between the stud and the gear.

17. The image forming apparatus according to claim 16, wherein a position of each of the plurality of driving coupling members is changed between an engaged position where the driving coupling member is engaged with the corresponding driven coupling member and a disengaged position where the driving coupling member is disengaged from the corresponding driven coupling member; and the gear and the cam member are kept at a constant distance to prevent friction therebetween at the engaged position.

18. The image forming apparatus according to claim 15, wherein:

the developing device includes a developing process device to perform an image forming process and a developer replenishment device to replenish developer in the developing process device; and the drive device includes a developer shutter link to adjust the supply of developer from the developer replenishment device to the developing process device.

* * * * *